US009801437B2

(12) United States Patent
Ho

(10) Patent No.: US 9,801,437 B2
(45) Date of Patent: Oct. 31, 2017

(54) WALKING EQUIPMENT WITH A LIGHTING APPARATUS AND USAGE METHOD THEREOF

(71) Applicant: Ko-Liang Ho, New Taipei (TW)

(72) Inventor: Ko-Liang Ho, New Taipei (TW)

( * ) Notice: Subject to any disclaimer, the term of this patent is extended or adjusted under 35 U.S.C. 154(b) by 30 days.

(21) Appl. No.: 14/992,458

(22) Filed: Jan. 11, 2016

(65) Prior Publication Data

US 2017/0196321 A1 Jul. 13, 2017

(51) Int. Cl.
*A45B 3/04* (2006.01)
*A45B 9/00* (2006.01)
*F21V 33/00* (2006.01)

(52) U.S. Cl.
CPC ..... *A45B 3/04* (2013.01); *A45B 2009/002* (2013.01); *F21V 33/0064* (2013.01)

(58) Field of Classification Search
CPC ..... A45B 3/02; A45B 3/04; A45B 2009/002; F21V 33/0064
USPC ..... 135/910; 362/102
See application file for complete search history.

(56) References Cited

U.S. PATENT DOCUMENTS 4,837,666 A * 6/1989 Conkle ..... A45B 1/00 135/65
5,575,294 A * 11/1996 Perry ..... A45B 3/00 362/102
5,597,309 A * 1/1997 Riess ..... A61F 9/08 434/258
5,702,082 A * 12/1997 Evans ..... F21V 21/08 248/214
6,508,580 B2 * 1/2003 Collins ..... A45B 3/00 280/288.4
6,930,603 B2 * 8/2005 Jackson ..... G08B 21/22 135/65
6,959,996 B2 * 11/2005 Ip ..... F21V 33/006 362/102
7,059,738 B1 * 6/2006 Nobayashi ..... A45B 3/04 135/66
8,087,421 B2 * 1/2012 Gorey ..... A45B 3/04 135/65
8,157,226 B2 * 4/2012 Peregrine ..... G03B 15/02 248/200
8,573,795 B1 * 11/2013 Lai ..... A45B 3/04 362/102
8,702,567 B2 * 4/2014 Hu ..... A61H 3/00 482/8

(Continued)

FOREIGN PATENT DOCUMENTS

TW DE 202016102492 U1 * 6/2016 ..... A45B 3/04

*Primary Examiner* — David R Dunn
*Assistant Examiner* — Danielle Jackson
(74) *Attorney, Agent, or Firm* — Li & Cai Intellectual Property (USA) Office

(57) ABSTRACT

A walking equipment with a lighting apparatus includes a main body, a mount, at least one lighting apparatus, and a power apparatus. The main body has a grip, and the mount is disposed in the main body. The lighting apparatus is connected the mount and projects a horizontal line beam and a vertical line beam. The power apparatus is electrically connected the lighting apparatus. The lighting apparatus is turned on and projects a vertical line marking and a horizontal line marking onto the ground, so the user is guided and takes a step by referring the vertical line marking and horizontal line marking to prevent falling and unforeseen accident.

7 Claims, 15 Drawing Sheets

(56) References Cited

U.S. PATENT DOCUMENTS

| | | | | |
|---|---|---|---|---|
| 8,746,264 | B2 * | 6/2014 | Gorey | A45B 3/04 135/65 |
| 8,810,407 | B1 * | 8/2014 | Nolan | A61H 3/02 340/407.1 |
| 8,827,485 | B2 * | 9/2014 | Liao | F21V 21/0885 362/191 |
| 9,125,790 | B2 * | 9/2015 | Van Gerpen | A61H 3/04 |
| 2005/0151040 | A1 * | 7/2005 | Hsu | B62J 11/00 248/214 |
| 2006/0292533 | A1 * | 12/2006 | Selod | A63B 71/0686 434/247 |
| 2008/0062675 | A1 * | 3/2008 | Tung | E04H 15/10 362/102 |
| 2008/0084690 | A1 * | 4/2008 | Rappl | F21V 33/0064 362/184 |
| 2012/0085378 | A1 * | 4/2012 | Chakraborty | A45B 3/04 135/66 |
| 2013/0027912 | A1 * | 1/2013 | Liao | A45B 3/02 362/102 |
| 2013/0167888 | A1 * | 7/2013 | LoSasso | A63B 71/0622 135/66 |
| 2016/0309861 | A1 * | 10/2016 | Chou | A45B 3/04 |
| 2017/0003008 | A1 * | 1/2017 | Ito | F21V 21/30 |

* cited by examiner

WALKING EQUIPMENT WITH A LIGHTING APPARATUS AND USAGE METHOD THEREOF

BACKGROUND OF THE INVENTION

1. Field of the Invention

The present invention is related to a walking equipment with a lighting apparatus and usage method thereof.

2. Description of Related Art

A walking equipment is a device configured to assist the disabled patient or senior, or persons with physical impairment disabilities. However, traditional walking equipment does not have an assisting function for learning to walk, so the user falls easily due to walking too fast or taking too big a step.

SUMMARY OF THE INVENTION

The object of the instant disclosure is to provide a walking equipment with a lighting apparatus and usage method thereof. The walking equipment according to the present invention is configured to guide the user for walking and controlling the length of the step, prevent falling and reduce unforeseen accidents.

In order to overcome the abovementioned problem, the present invention provides a walking equipment with a lighting apparatus which includes a main body, a mount, at least one lighting apparatus, and a power apparatus. The main body has a grip, and the mount is installed on the main body. The at least one lighting apparatus is connected to the mount and is capable of emitting a horizontal line beam and a vertical line beam. The power apparatus is electrically connected the at least one lighting apparatus. The at least one lighting apparatus is configured to project a vertical line marking and a horizontal line marking onto the ground.

The present invention has the following advantages:

The walking equipment with a lighting apparatus of the present invention is designed to project a vertical line marking and a horizontal line marking onto the ground and provides a learning walking path for assisting the user. The walking equipment with a lighting apparatus according to the present invention is configured to guide the user to adjust the length of their step, prevent falling and reducing unforeseen accident.

In order to further appreciate the characteristics and technical contents of the present invention, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

<First Embodiment>

Figure 1:
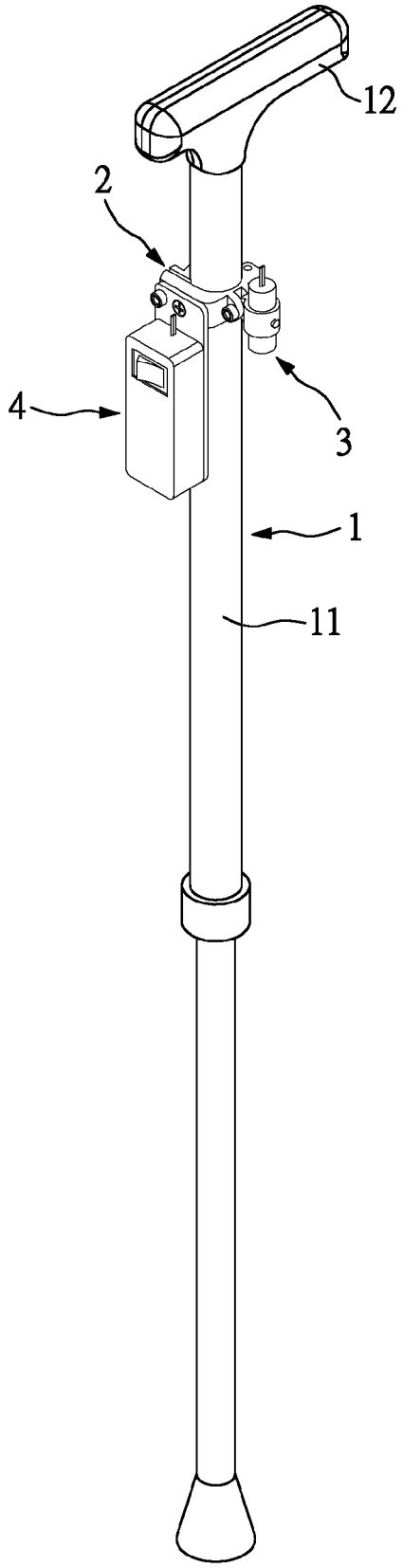
FIG. 1 shows a perspective view of a walking equipment with a lighting apparatus of a first embodiment in the instant disclosure.
Figure 2:
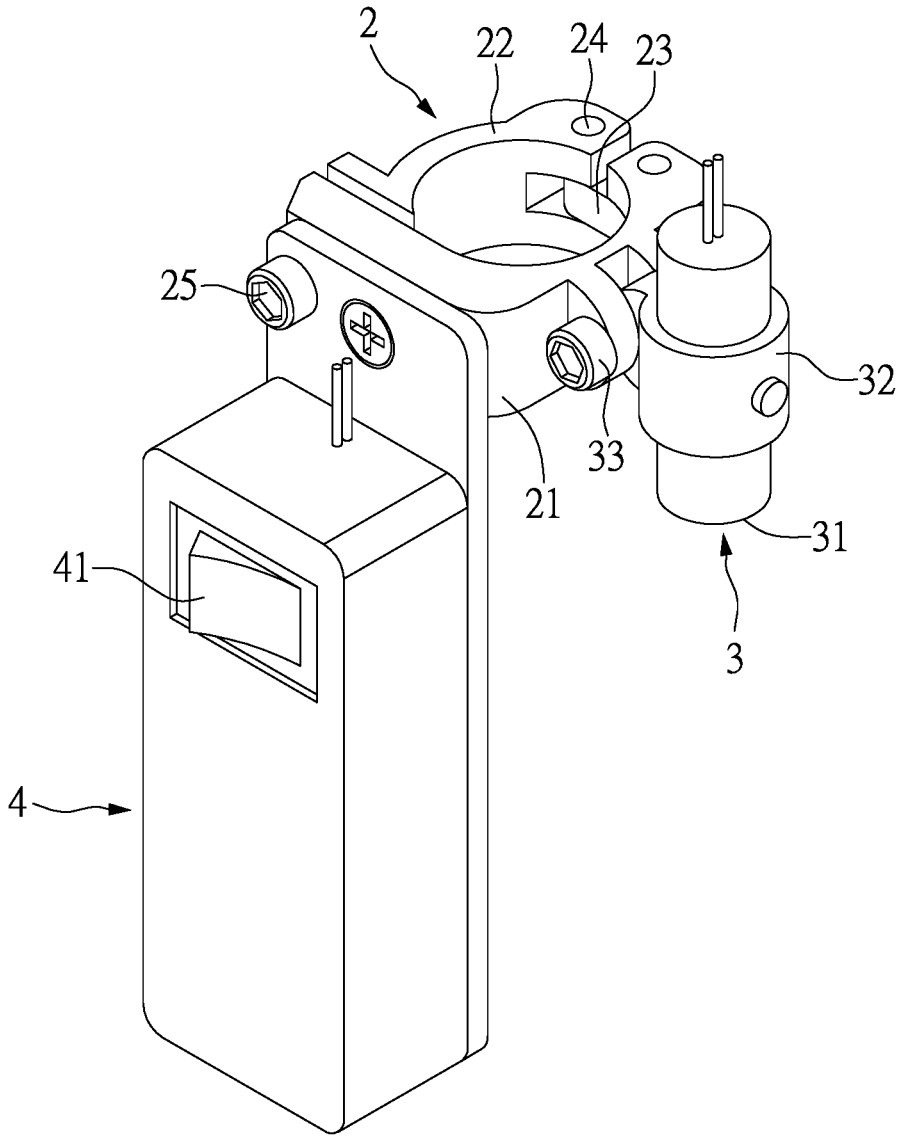
FIG. 2 shows a partial perspective view of the walking equipment with a lighting apparatus of the first embodiment in the instant disclosure.
Figure 3:
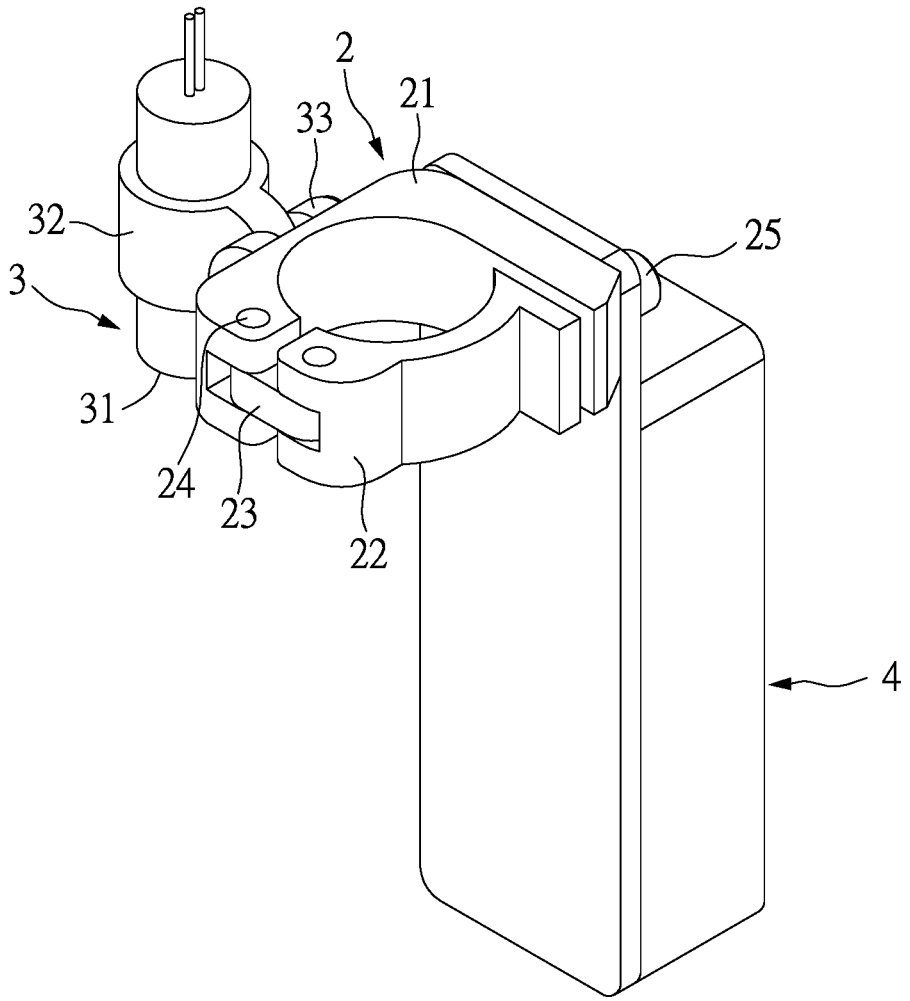
FIG. 3 shows an another partial perspective view of the walking equipment with a lighting apparatus of the first embodiment in the instant disclosure.

Please refer to FIGS. 1 to 3. The instant disclosure provides a walking equipment with a lighting apparatus, wherein the walking equipment is, but is not limited to, stick or reciprocal frame. In this embodiment, the walking equipment is a stick.

The walking equipment includes a main body 1, a mount 2, at least one lighting apparatus, and a power apparatus 4. In this embodiment, the main body 1 is a stick, the main body 1 has a pole 11, and the pole 11 is vertical and the length of the pole is fixed or can be adjusted as required. A grip 12 is disposed on the top end of the pole 11 for holding. The abovementioned stick is a conventional technique and is not described any further.

The mount 2 is disposed on the main body 1 and is configured to fix the lighting apparatus 3 and power apparatus 4 on the main body 1. The mount 2 may be, but is not limited to being, removably fixed to the main body 1 by the manners of clipping, engaging, surrounding, or screwing.

The mount 2 is assembled of one, two, or multiple parts. In this embodiment, the mount 2 is assembled of multiple parts, and includes a first seat 21, a second seat 22, and a connecting member 23. The first seat 21 is with a L shape, the second seat 22 is with an arc shape, and inner sides of the first seat 21 and second seat 22 form an arc surface, so the first seat 21 and second seat 22 are integrated into a ring-shape seat with an annular inner wall. Two ends of the connecting member 23 are pivoted to one end of the first seat 21 and one end of the second seat 22 respectively. More specifically, two ends of the connecting member 23 are pivoted to the one end of the first seat 21 and the one end of the second seat 22 by a shaft 24 respectively, so the first seat 21, the second seat 22, and the connecting member 23 are connected and integrated into the ring-shaped seat and installed around the pole 11 of the main body 1. Another end of the first seat 21 and another end of the second seat 22 are fastened by a locking mechanism, such as a screw 25. In other words, the screw 25 penetrates through the another end of the first seat 21 and another end of the second seat 22, so the mount 2 is installed firmly on the main body 1 and can be detached quickly. In this embodiment, the mount 2 is assembled by three parts and is adjustable to fit the shape of the pole 11 of the main body 1.

The number of the lighting apparatus 3 is one, two or more, and the lighting apparatus may be, but is not limited to, a laser module or LED module. The lighting apparatus 3 is capable of emitting a horizontal line beam and vertical line beam. The lighting apparatus 3 includes an emitting portion 31 facing downward. More specifically, a grating (not shown) is installed inside the lighting apparatus 3, and the lighting apparatus 3 generates light through the grating and emits a vertical line beam and a horizontal line beam from the emitting portion 31 while the lighting apparatus is turned on. In case two lighting apparatuses 3 are installed, then one of the lighting apparatuses 3 emits the vertical line beam whereas another lighting apparatus 3 emits the horizontal line beam. If there is only one lighting apparatus 3 installed, then the lighting apparatus 3 emits the vertical line beam and the horizontal line beam simultaneously. In this embodiment, only one lighting apparatus 3 is installed and the lighting apparatus 3 emits the vertical line beam and the horizontal line beam simultaneously which form a cross type line beam. The detail of the lighting apparatus 3 capable of emitting vertical and horizontal line beams is a conventional technique and is not described any further.

The lighting apparatus 3 is installed in the mount 2 firmly or rotationally. In this embodiment, the lighting apparatus 3 is rotatably disposed in the mount 2, more specifically, the lighting apparatus 3 is installed in a sleeve 32, and one side of the sleeve 32 is pivoted to one side of the mount 2 by a shaft 33, and the shaft 33 is installed horizontally, so the sleeve 32 and the lighting apparatus 3 can be rotated with the center at the axis of the shaft 33, and configured to adjust the emitting angle of the lighting apparatus 3.

The power apparatus 4 is a battery case having the battery inside. The power apparatus 4 is connected to the lighting apparatus 3 to provide the electric power. The power apparatus 4 has a switch 41 to turn on or turn off the lighting apparatus 3. The power apparatus 4 is not limited to the abovementioned design and could connect to an external power apparatus.

Figure 4:
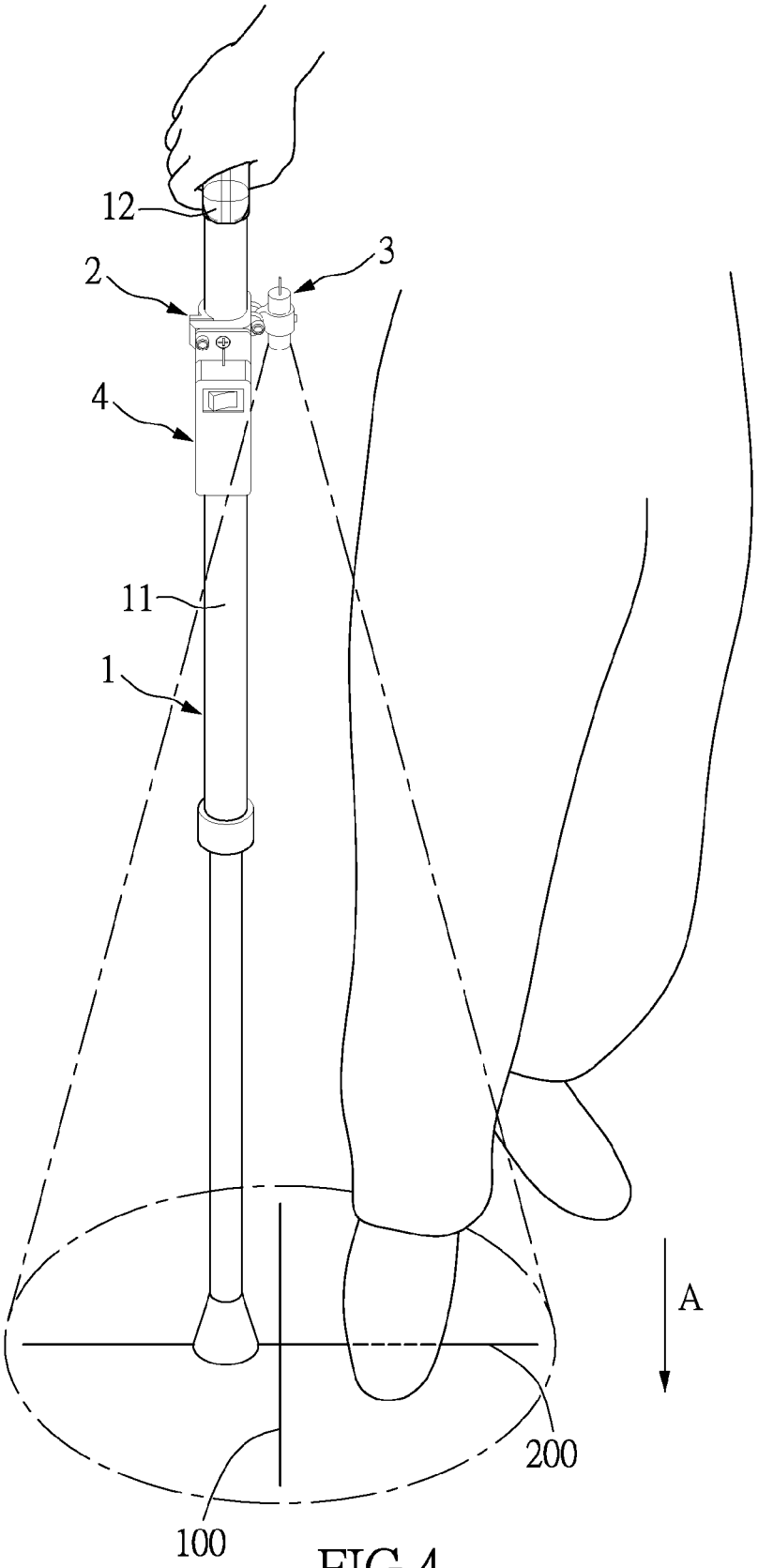
FIG. 4 shows a schematic operation view of the walking equipment with a lighting apparatus of the first embodiment in the instant disclosure.

Please refer to FIG. 4. The lighting apparatus 3 emits a horizontal line beam and a vertical line beam when the lighting apparatus 3 is turned on. More specifically, the lighting apparatus 3 projects a vertical line marking 100 and a horizontal line marking 200 onto the ground near the walking equipment. The vertical line marking 100 is extend toward the heading direction A of user, whereas the horizontal line marking 200 is extend toward left and right direction of the user and is perpendicular to the heading direction A. The vertical line marking 100 can either intersect or not intersect the horizontal line marking 200. The vertical line marking 100 and the horizontal line marking 200 divides the pavement into a plurality of areas. The vertical line marking 100 and horizontal line marking 200 are configured to guide the user for walking and adjusting the length of a step.

[Second Embodiment]

Figure 5:
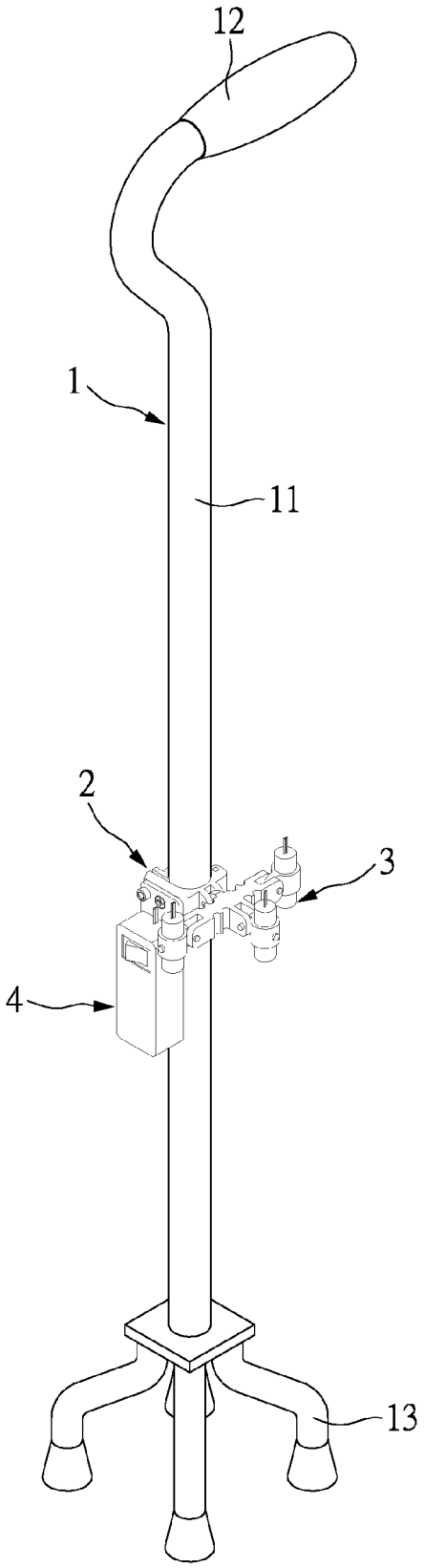
FIG. 5 shows a perspective view of the walking equipment with a lighting apparatus of a second embodiment in the instant disclosure.
Figure 6:
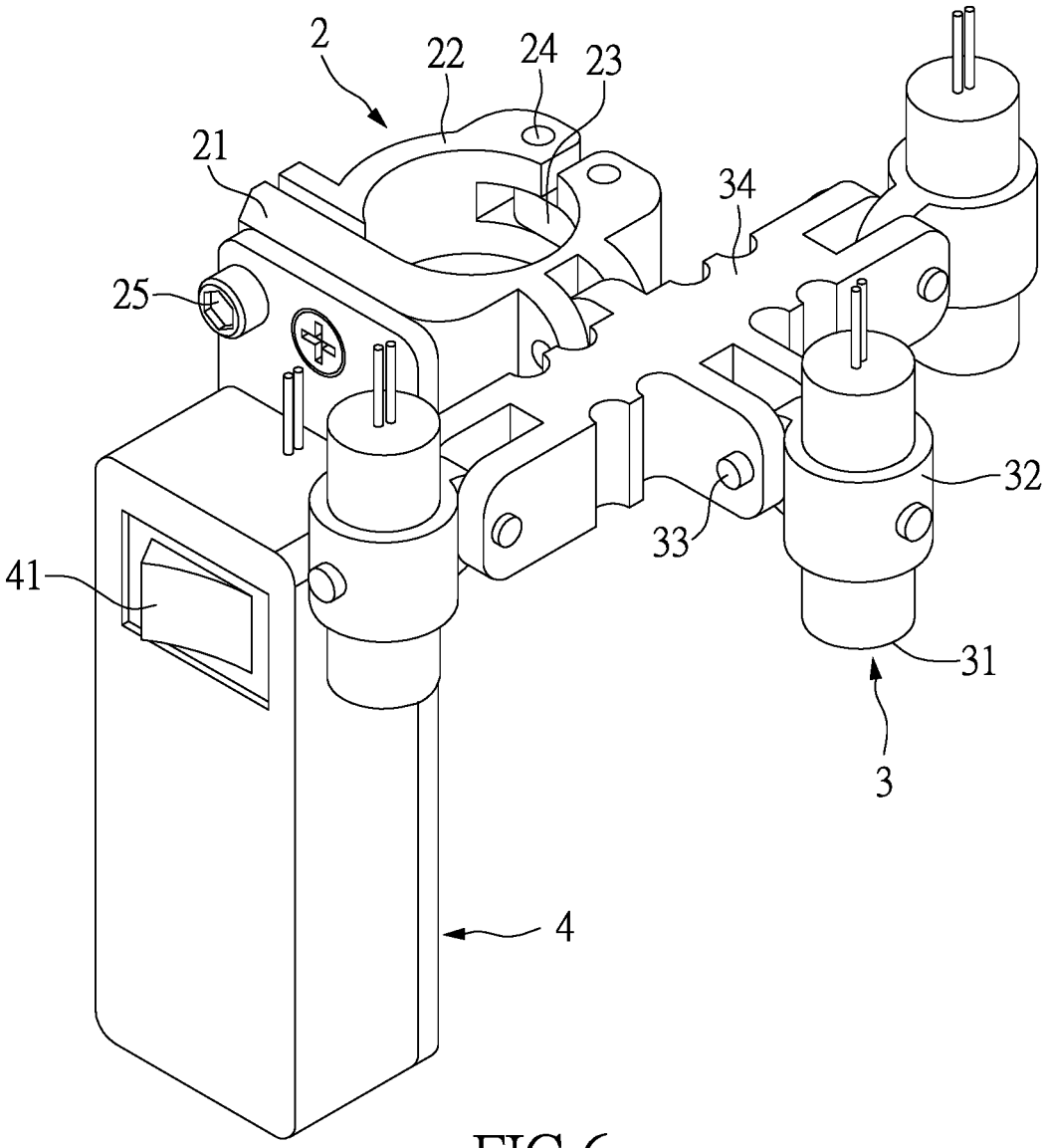
FIG. 6 shows a partial perspective view of the walking equipment with a lighting apparatus of the second embodiment in the instant disclosure.
Figure 7:
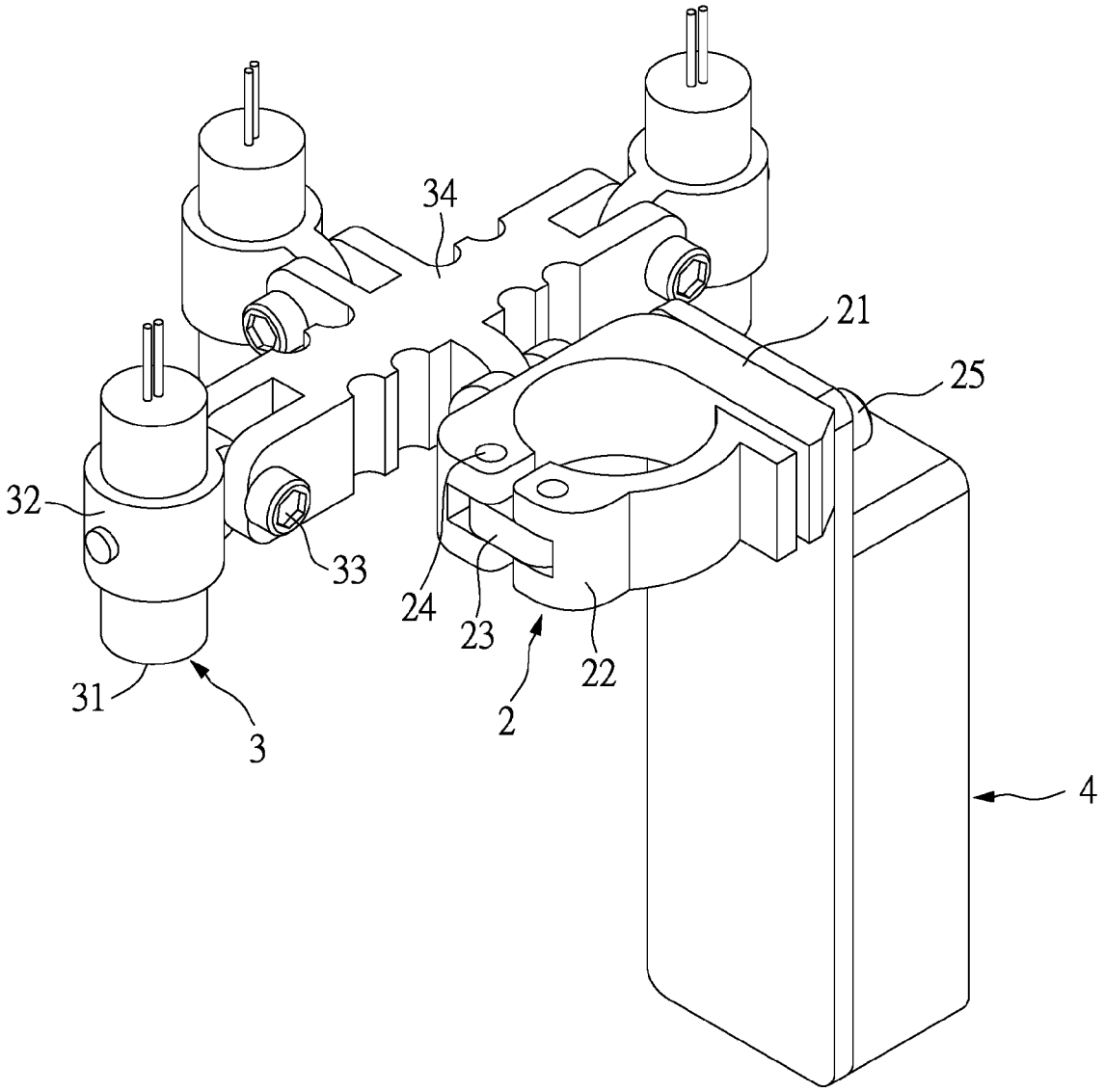
FIG. 7 shows another partial perspective view of the walking equipment with a lighting apparatus of the second embodiment in the instant disclosure.

Please refer to FIGS. 5 to 7. The difference between the second embodiment and the first embodiment is that the walking equipment in this embodiment has a main body 1 with a pole 11. A grip 12 is disposed on the top end of the pole 11, and a plurality of stands 13 are installed on bottom end of the pole 11, so the main body 1 stands on the ground steadily. The mount 2 is disposed around the pole 11 of the main body 1, so the mount 2 is fixed to the main body 1.

In this embodiment, the number of the lighting apparatus 3 is three, wherein two of the lighting apparatuses 3 emit the vertical line beam and horizontal line beam respectively, and the other lighting apparatus 3 emits a horizontal line beam, and these beams are intersected with each other and formed a H shaped character.

The lighting apparatuses 3 are connected to the mount 2. In this embodiment, the lighting apparatuses 3 are rotatably connected to the mount 2, and more specifically, the lighting apparatuses 3 are fixed to a sleeve 32 respectively, one side of the sleeve 32 pivoted to a connecting seat 34 disposed on one side of the mount 2 by a shaft 33. The shaft 33 is disposed horizontally, so the sleeves 32 and the lighting apparatuses 3 are rotated with the center at the axis of the shafts 33 for adjusting the emitting angle of the lighting apparatuses 3. In this embodiment, the three lighting apparatuses 3 are disposed on two ends and the middle portion of the connecting seat 34 respectively by the sleeves 32. The power apparatus 4 is electrically connected the lighting apparatuses 3 and supplies power to the lighting apparatuses 3.

Figure 8:
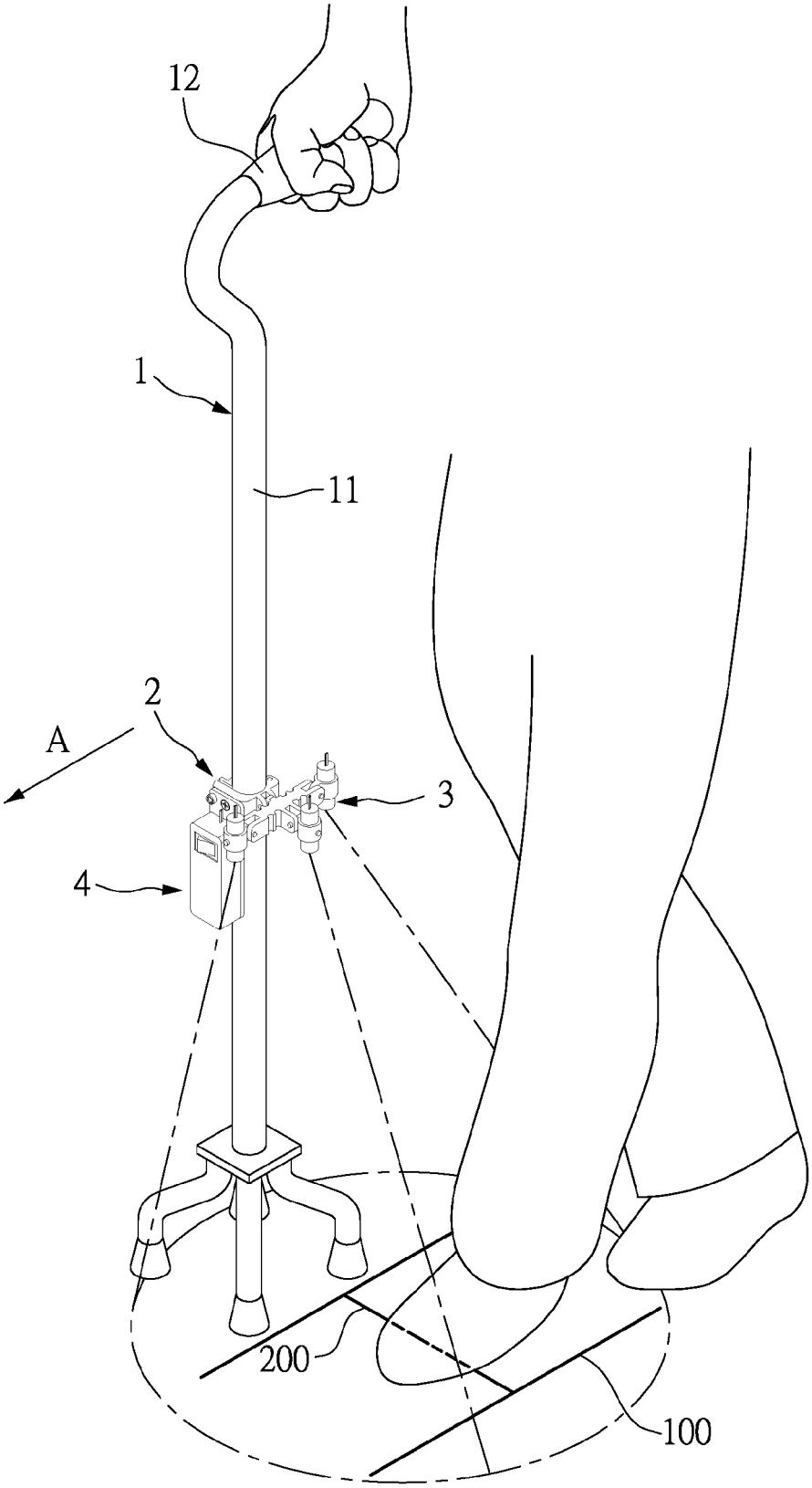
FIG. 8 shows a schematic operation view of the walking equipment with a lighting apparatus of the second embodiment in the instant disclosure.

Please refer to FIG. 8. The lighting apparatuses 3 are turned on and project the horizontal line beam and vertical line beam. In other words, the lighting apparatuses 3 project two vertical line markings 100 and one horizontal line marking 200. The vertical line markings 100 and the horizontal line marking 200 form a learning walking path and guide the user to adjust their length of step.

[Third Embodiment]

Figure 9:
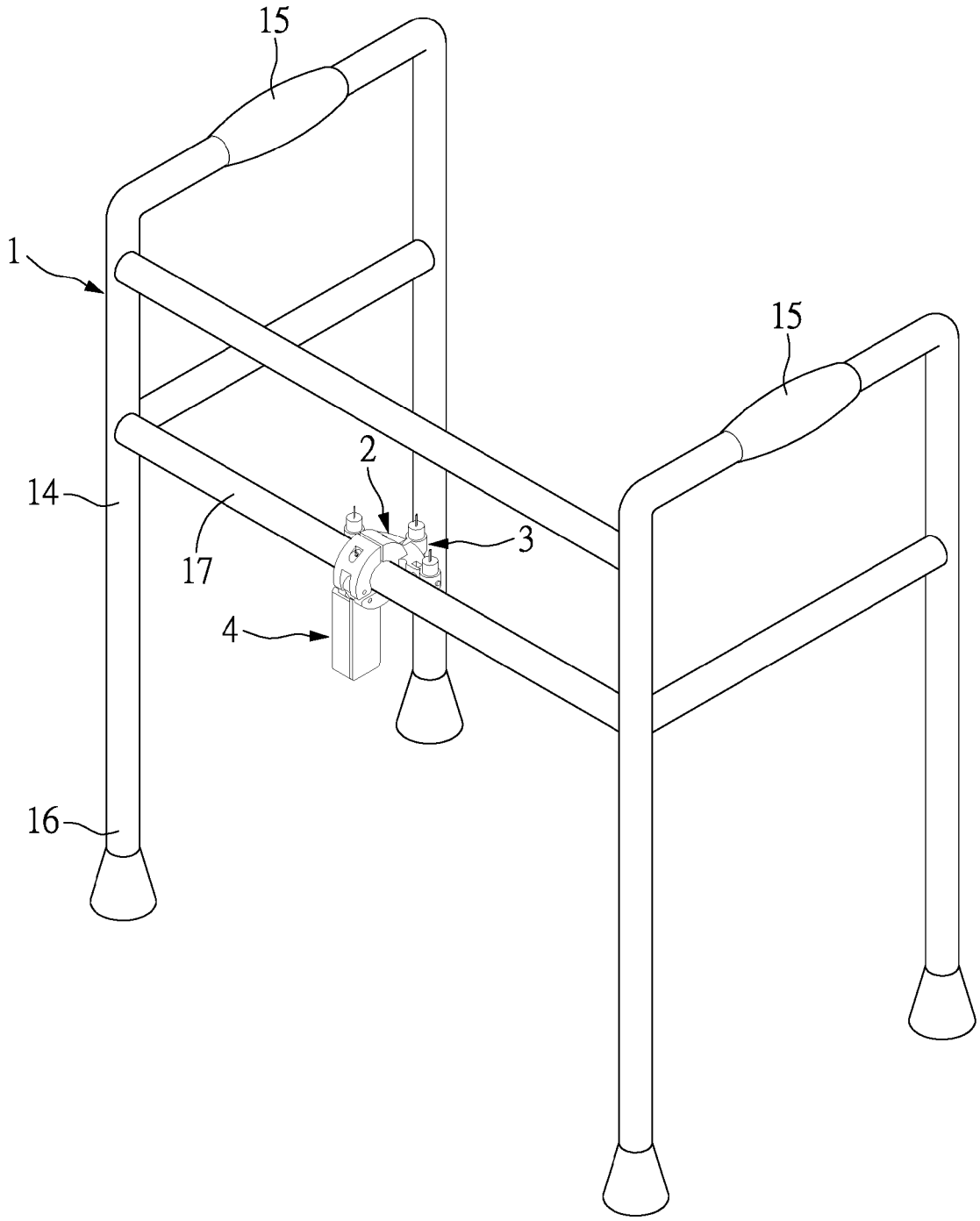
FIG. 9 shows a perspective view of the walking equipment with a lighting apparatus of a third embodiment in the instant disclosure.
Figure 10:
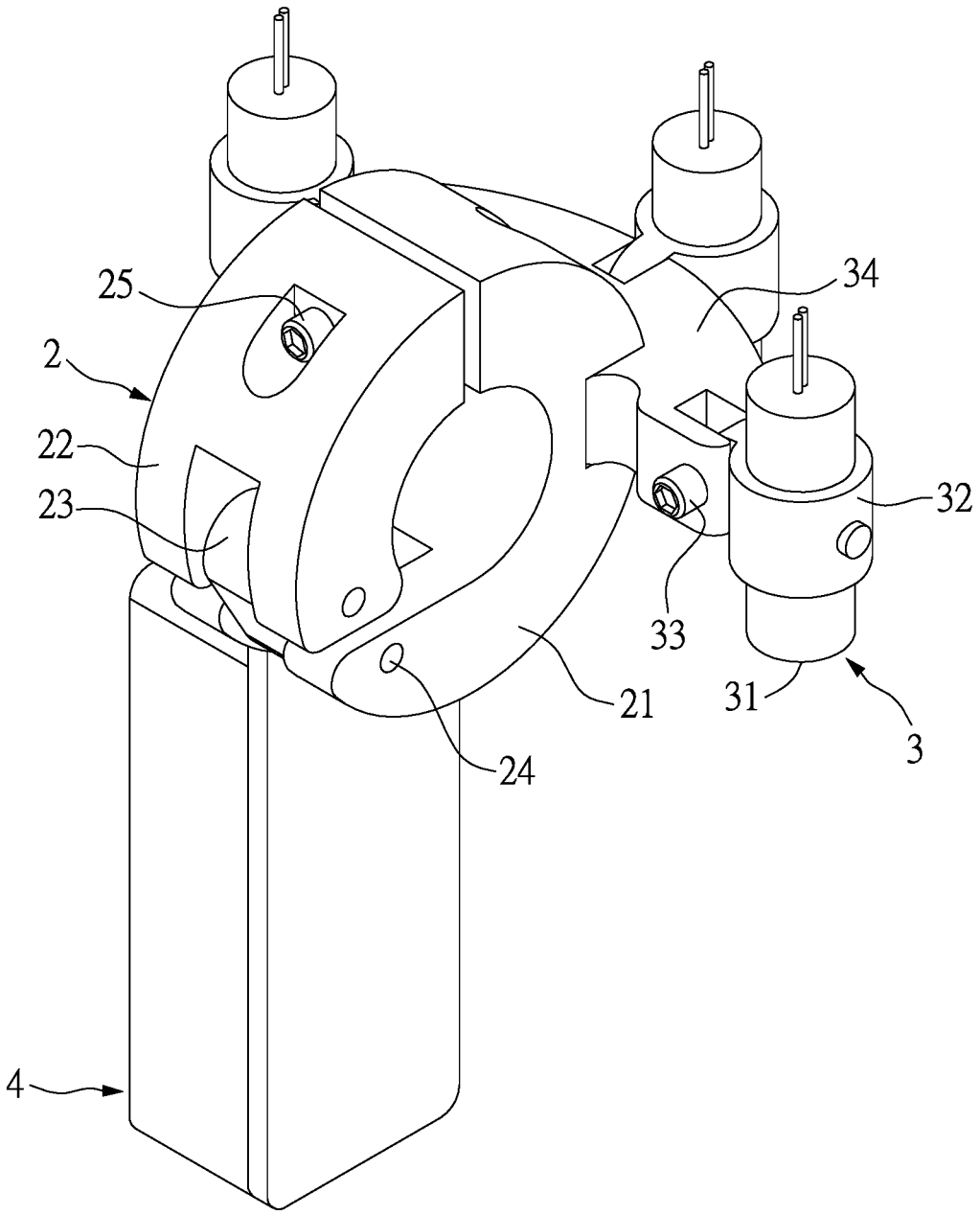
FIG. 10 shows a partial perspective view of the walking equipment with a lighting apparatus of the third embodiment in the instant disclosure.
Figure 11:
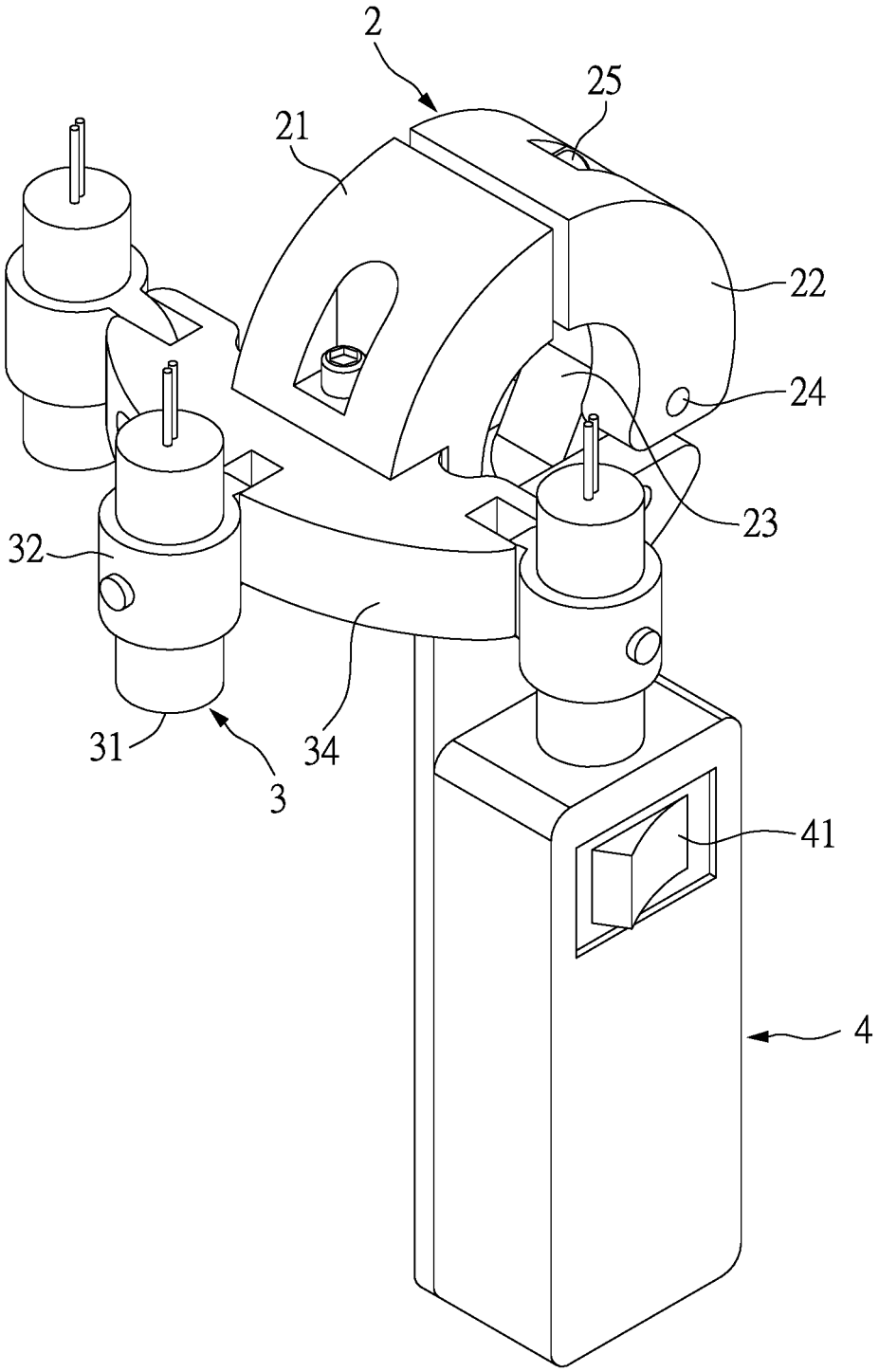
FIG. 11 shows an another partial perspective view of the walking equipment with a lighting apparatus of the third embodiment in the instant disclosure.

Please refer to FIGS. 9 to 11. The difference between the first embodiment and the third embodiment is that the main body 1 of the walking equipment in this embodiment has two frames 14. The frames 14 are in the shape of inverted U. Two grips 15 are disposed on the top end of the frames 14 respectively for holding. Two stands 16 are disposed on the bottom end of the frame 14, so the main body 1 stands on the ground steadily. A pole 17 is disposed between the two frames 14. The pole 17 is installed laterally, so the mount 2 is fixed to the main body 1.

In this embodiment, the number of the lighting apparatuses 3 is three. The lighting apparatuses 3 emit a vertical line beam and a cross line beam. More specifically, two lighting apparatuses 3 emit the vertical line beam respectively, and the other lighting apparatus 3 emits the cross line beam. The vertical line beam and the cross line beam are intersected each other.

The lighting apparatuses 3 are connected the mount 2. In this embodiment, the lighting apparatuses 3 are rotatably connected to the mount 2. More specifically, the lighting apparatuses 3 are fixed to sleeves 32 respectively, and one side of the sleeve 32 is pivoted to a connecting seat 34 disposed on one side of the mount seat 2 by a shaft 33, and the shaft 33 is installed horizontally, so the sleeve 32 and the light apparatus 3 are rotated with the center at the axis of the shaft 33 for adjusting the emitting angle of the lighting apparatus 3. The power apparatus 4 is electrically connected to the lighting apparatuses 3 and supplies power to the lighting apparatuses 3.

Figure 12:
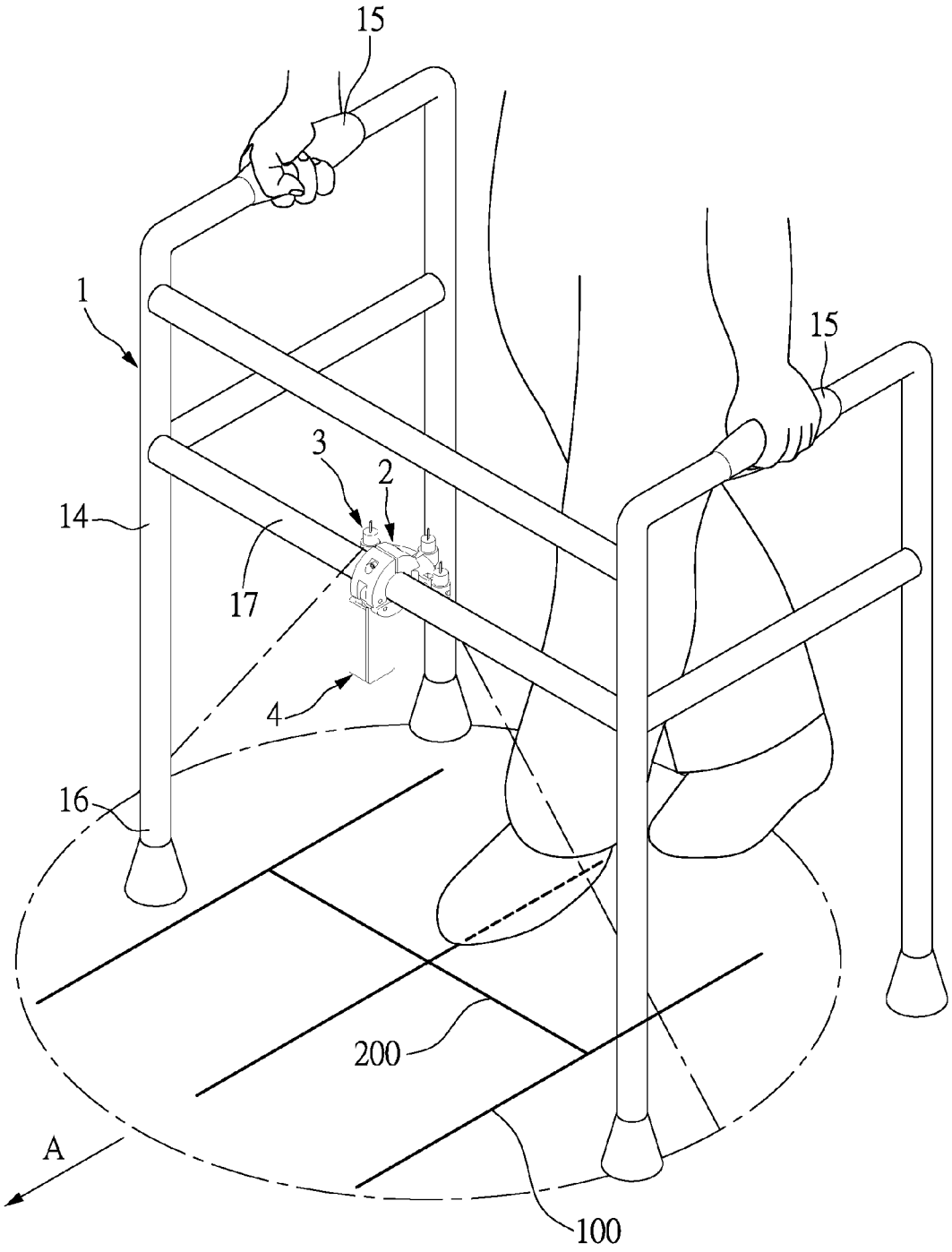
FIG. 12 shows a schematic operation view of the walking equipment with a lighting apparatus of the third embodiment in the instant disclosure.

Please refer to FIG. 12. The lighting apparatuses 3 are turned on and project the horizontal line beam and the vertical line beam, in other words, the lighting apparatuses 3 project three vertical line markings 100 and a horizontal line marking 200. The vertical line markings 100 and the horizontal line marking 200 form a learning walking path and guide the user to adjust their length of step.

[Fourth Embodiment]

Figure 13:
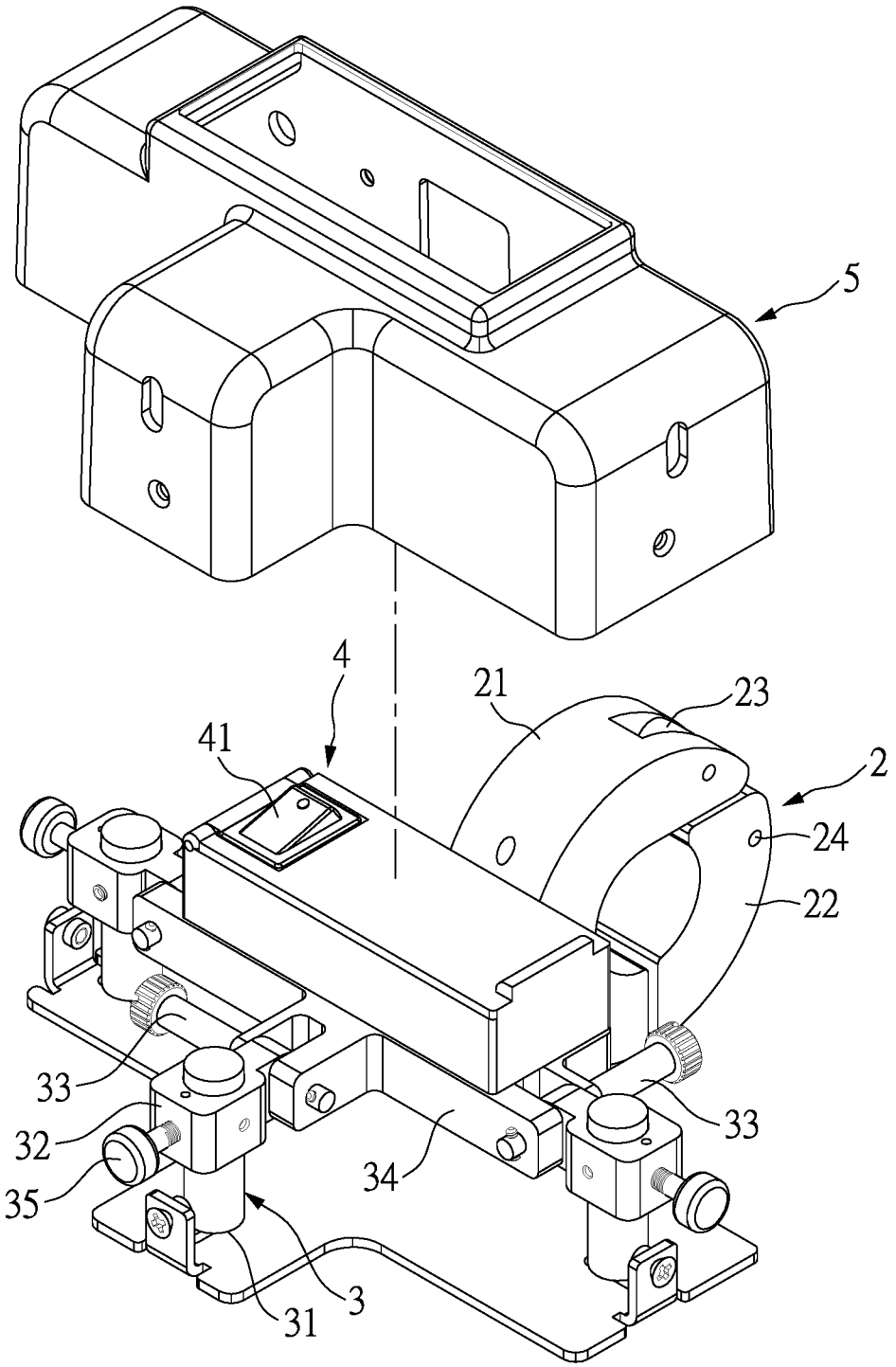
FIG. 13 shows a perspective view of the walking equipment with a lighting apparatus of a fourth embodiment in the instant disclosure.
Figure 14:
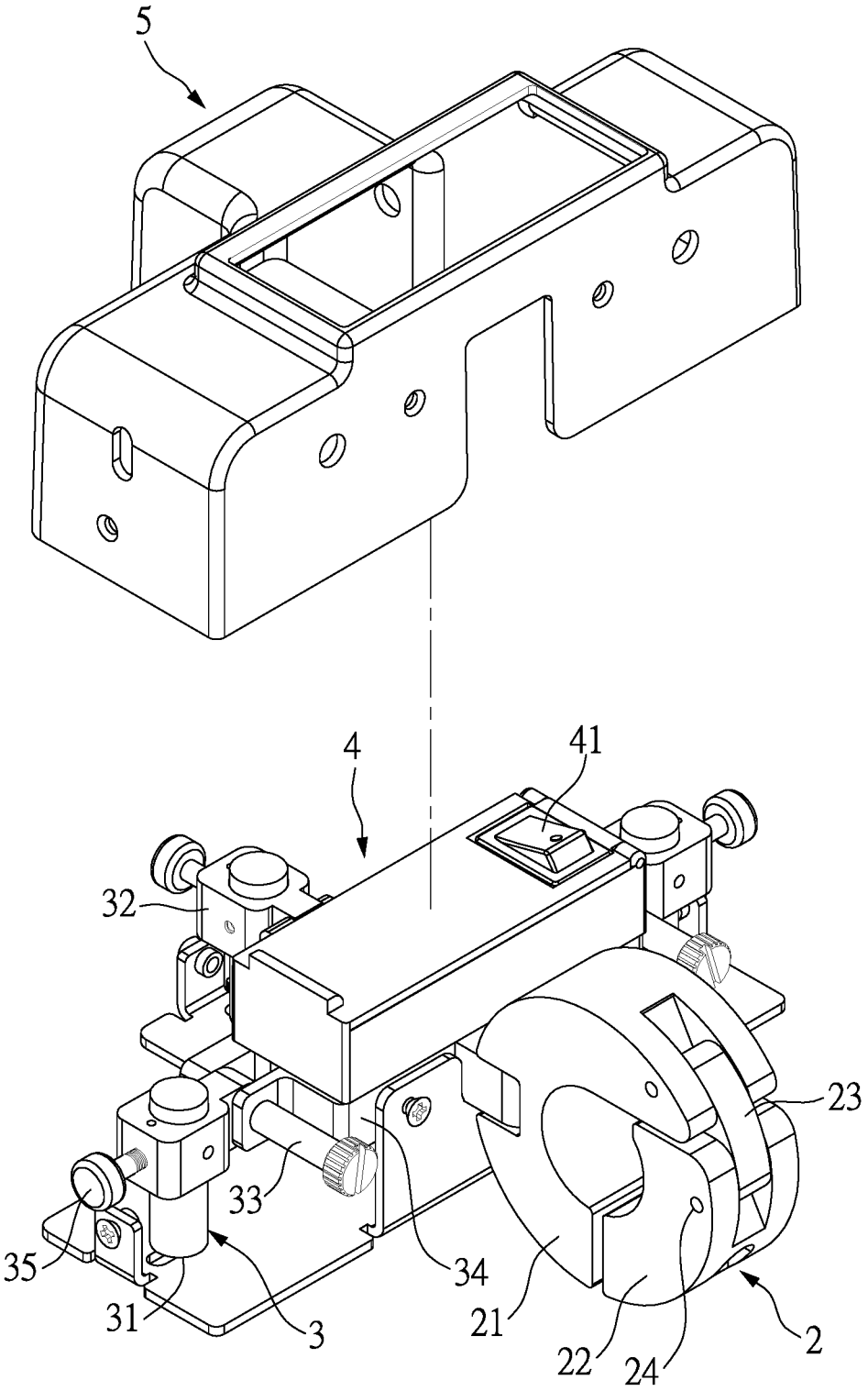
FIG. 14 shows an another perspective view of the walking equipment with a lighting apparatus of the fourth embodiment in the instant disclosure.

Please refer to FIGS. 13 and 14. In this embodiment, the shape and the structure of the mount 2, the lighting apparatuses 3, and the power apparatus 4 are modified slightly, but the function of these elements is the same with the elements of the aforementioned embodiment. In this embodiment, one side of the sleeve 32 is pivoted to the one side of the mount 2 by a shaft 33. The shaft 33 is disposed horizontally, so the sleeve 32 and the light apparatus 3 are rotated with the center at the axis of the shaft 33 for adjusting the emitting angle of the lighting apparatus 3. The shaft 33 is a screw, so the sleeve 32 can be fastened or loosened by rotating the shaft 33 for adjusting the lighting apparatus 3. The sleeve 32 further connects a lever 35, and the lever 35 is configured to adjust the emitting angle of the lighting apparatus 3. In this embodiment, a housing 5 covers the mount 2, the lighting apparatus 3 and the power apparatus 4 so as to make it look more appealing.

Figure 15:
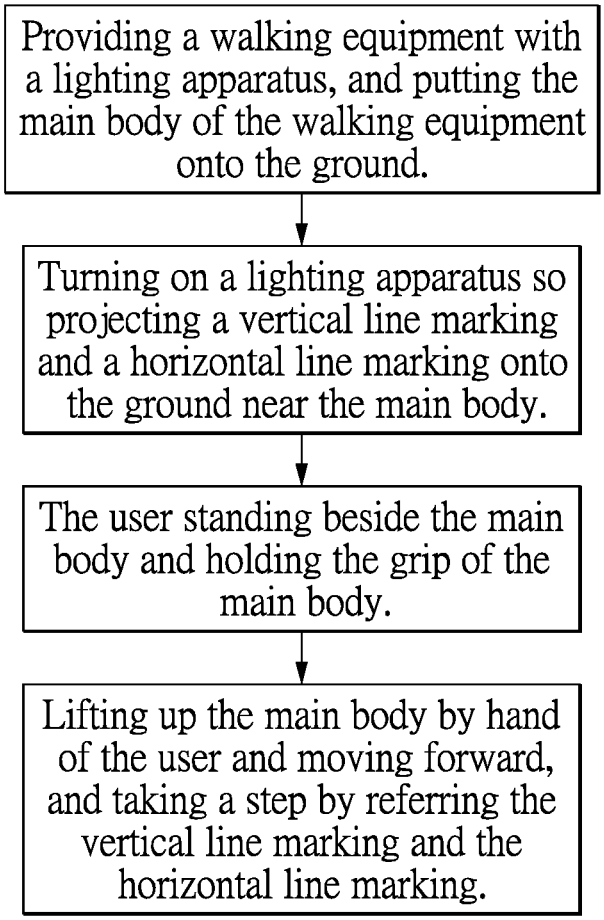
FIG. 15 shows a flow chart of a usage method of a walking equipment with a lighting apparatus in the instant disclosure.

Please refer to FIG. 15. The instant disclosure further provides a usage method of a walking equipment with a lighting apparatus, and includes the steps as follows:

At first, the present invention provides a walking equipment with a lighting apparatus (as shown in FIGS. 1 to 12), putting the walking equipment with a lighting apparatus on the ground. Please refer to the aforementioned embodiments for the detail of the walking equipment with a lighting apparatus.

The light apparatus 3 is turned on and then projects a vertical line marking 100 and horizontal line marking 200 onto the ground.

The user stands beside the walking equipment with a lighting apparatus, and holds the grip 12 or grip 15 of the main body 1, namely, a single hand holds the grip 12 of the main body 1 or both hands hold the grips 15 of the main body 1.

The user lifts the walking equipment with a lighting apparatus and moves forward, and drives the body forward by hand. The user refers to the vertical line marking 100 and horizontal line marking 200 and takes a step. The vertical line marking 100 is regarded as a reference of the heading direction and moving boundaries, and the horizontal line marking 200 is regarded as a reference of the length of taking a step, so the user sets foot on a proper position and moves forward accordingly.

According to the embodiment of the present invention, the walking equipment with a light apparatus projects a vertical line marking and a horizontal line marking on the ground near the main body, and provides a learning walking path and assists in walking. The walking equipment of the present invention guides the user to control the length of their step, and prevents falling and reduces unforeseen accidents.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A walking equipment with a lighting apparatus, comprising:

a main body having a grip;

a mount disposed on the main body;

at least one lighting apparatus installed on the mount, and emitting a vertical line beam and a horizontal line beam; and a power apparatus electrically connected to the at least one lighting apparatus;

wherein the at least one lighting apparatus projects a vertical line marking and a horizontal line marking onto the ground;

wherein the at least one lighting apparatus is fixed to a sleeve, one side of the sleeve is pivoted to a connecting seat disposed on one side of the mount by a shaft, and the shaft is disposed horizontally, so the at least one lighting apparatus is rotated with a central axis of the shaft, and the sleeve is connected to a lever;

wherein the number of the at least one lighting apparatus is three, and the three lighting apparatuses are disposed on two ends and a middle portion of the connecting seat respectively.

2. The walking equipment with a lighting apparatus according to claim 1, wherein the main body comprises a pole, the grip is disposed on a top end of the pole, and the mount is removably installed in the pole.

3. The walking equipment with a lighting apparatus according to claim 2, wherein a plurality of stands are disposed on the bottom end of the pole.

4. The walking equipment with a lighting apparatus according to claim 2, wherein the mount comprises a first seat, a second seat, and a connecting member, inner sides of the first seat and the second seat form an arc surface, and two ends of the connecting member are pivoted to one end of the first seat and one end of the second seat respectively, the first seat, the second seat, and the connecting member are disposed on the pole of the main body, and another end of the first seat is fixed to another end of the second seat by a locking mechanism.

5. The walking equipment with a lighting apparatus according to claim 1, wherein the main body has two frames and two grips, the two grips are disposed on the top end of the two frames respectively, and two stands are disposed on the bottom end of the two frames respectively, a pole is disposed laterally between the two frames, and the mount is removably installed on the pole of the main body.

6. The walking equipment with a lighting apparatus according to claim 5, wherein the mount comprises a first seat, a second seat, and a connecting member, inner sides of the first seat and the second seat form an arc surface, and two ends of the connecting member are pivoted to one end of the first seat and one end of the second seat respectively, the first seat, the second seat, and the connecting member are disposed on the pole of the main body, and another end of the first seat is fixed to another end of the second end by a locking mechanism.

7. A walking equipment with a lighting apparatus, comprising:

a main body having a grip and a pole;

a mount having a first seat, a second seat, and a connecting member, inner sides of the first seat and the second seat form an arc surface, two ends of the connecting member are pivoted to one end of the first seat and one end of the second seat, the first seat, the second seat and the connecting member disposed on the pole of the main body, and another end of the first seat fixed to another end of the second seat by a locking mechanism, so the mount is removably installed on the main body;

at least one lighting apparatus installed on the mount, and emitting a vertical line beam and a horizontal line beam; and a power apparatus electrically connected to the at least one lighting apparatus;

wherein the at least one lighting apparatus projects a vertical line marking and a horizontal line marking onto the ground;

wherein the at least one lighting apparatus is fixed on a sleeve, one side of the sleeve is pivoted to a connecting seat disposed on one side of the mount by a shaft, and the shaft is disposed horizontally, so the at least one lighting apparatus is rotated with a central axis of the shaft, and the sleeve is connected to a lever;

wherein the number of the at least one lighting apparatus is three, and the three lighting apparatuses are disposed on two ends and a middle portion of the connecting seat respectively.

* * * * *